US005337856A

United States Patent [19]

Fillers

[11] Patent Number: 5,337,856

[45] Date of Patent: Aug. 16, 1994

[54] LADDER ANCHORING PINS

[76] Inventor: James J. Fillers, 13805 Delaney Rd., Dale City, Va. 22193

[21] Appl. No.: 91,124

[22] Filed: Jul. 14, 1993

[51] Int. Cl.[5] ..... E06C 5/36

[52] U.S. Cl. ..... 182/107; 182/129; 248/500

[58] Field of Search ..... 182/107-111, 182/129, 93; 248/500, 508; 52/155, 156; 135/118

[56] References Cited

U.S. PATENT DOCUMENTS

| | | | |
|---|---|---|---|
| 776,446 | 11/1904 | Williamson . | |
| 1,091,091 | 3/1914 | Takach . | |
| 1,352,566 | 9/1920 | Voll . | |
| 1,412,582 | 4/1922 | Vacle | 52/155 |
| 1,427,889 | 9/1922 | Wittmann | 135/118 X |
| 1,672,787 | 6/1928 | Smith | 52/155 |
| 1,676,197 | 7/1928 | Macrinan | 52/156 |
| 2,127,035 | 7/1936 | Kirlin . | |
| 2,145,619 | 1/1938 | Brown . | |
| 2,253,535 | 10/1949 | Little . | |
| 3,534,751 | 10/1970 | Peters | 135/118 |
| 4,007,807 | 2/1977 | Pogwizd . | |
| 4,576,250 | 3/1986 | Marish . | |
| 4,669,576 | 6/1987 | Jones et al. . | |
| 4,756,128 | 7/1988 | Daniels | 135/118 X |
| 5,054,579 | 10/1991 | Moson . | |

*Primary Examiner*—Alvin C. Chin-Shue
*Attorney, Agent, or Firm*—Richard C. Litman

[57] ABSTRACT

An improved device for safely and effectively securing and stabilizing a ladder placed against a structure and resting upon the ground. The device includes a U-shaped member forming an anchoring pin, an impact area for receiving a driving force, and a handle for easy disengagement of the anchoring pin, for simultaneously engaging both the lowest rung of the ladder and the ground to prevent the ladder from inadvertently displacing across the ground away from the structure. For optimum safety, at least one anchoring pin placed across the center of the lowest ladder rung, or a pair of anchoring pins placed on opposite sides of the lowest rung will secure the ladder against lateral displacement and side-to-side tipping forces.

5 Claims, 3 Drawing Sheets

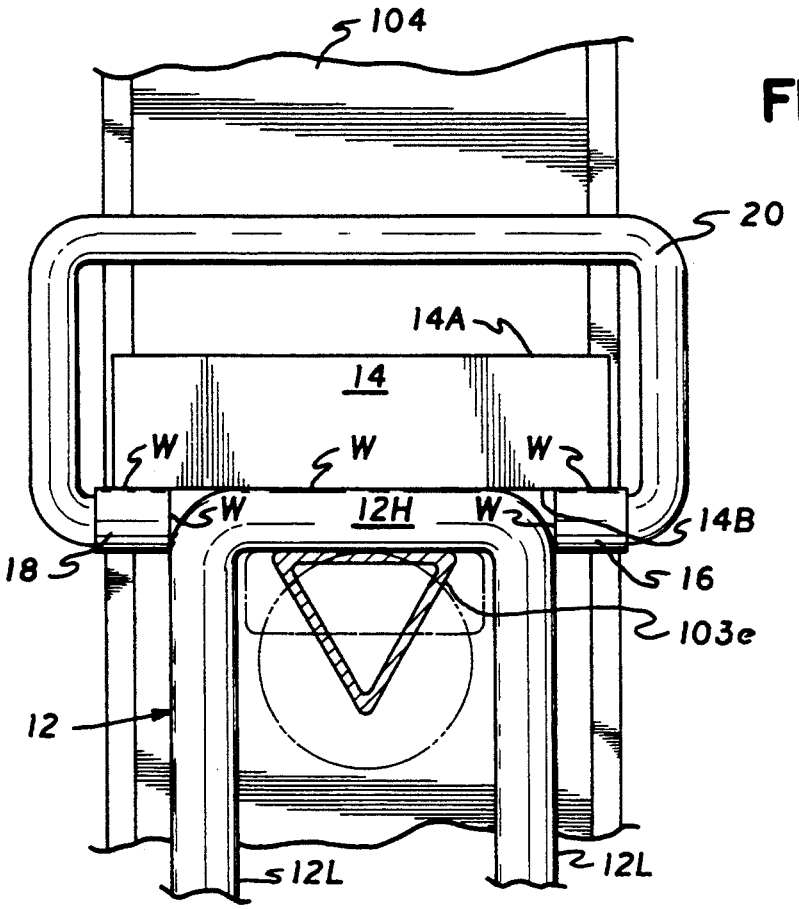
FIG. 3
FIG. 4
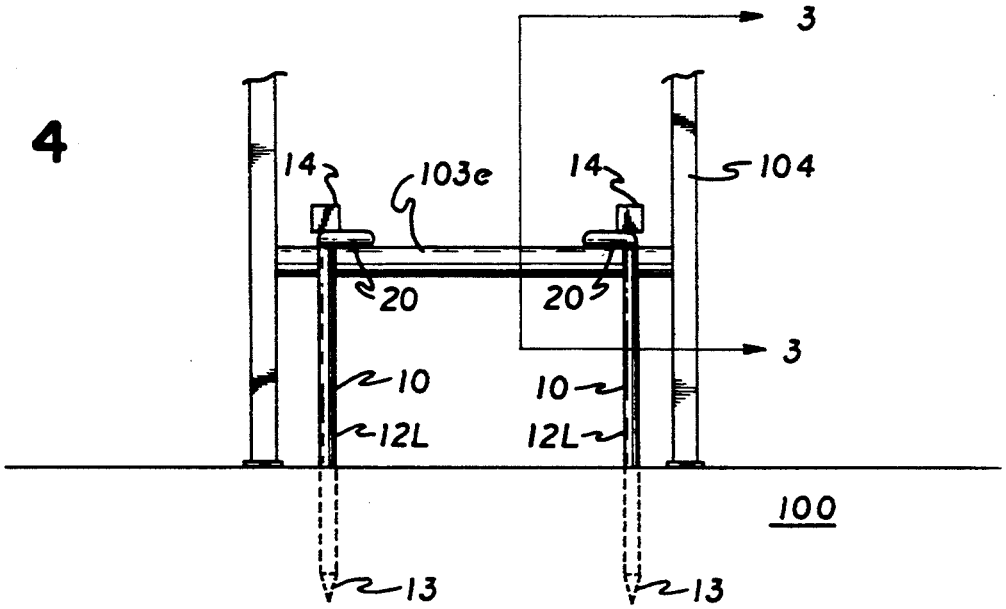

LADDER ANCHORING PINS

BACKGROUND OF THE INVENTION

1. Field of the Invention

The present invention relates to ladder stabilizing and anchoring devices. Specifically, the present invention relates to devices that stabilize and/or anchor a ladder to the ground by engaging the lowest horizontal foot rung of the ladder and are easily removed from the ground and transported by handles incorporated therein.

2. Description of the Prior Art

For reasons of safety, it is important for the lower end of a straight or extension ladder, that is supported by the ground and the side of a structure, to be anchored to the ground to prevent displacement of the ladder away from the building as well as to stabilize the ladder from slipping side to side. Attempts have been made in the past to accomplish this task as seen in the patented inventions presented herein.

U.S. Pat. No. 2,523,535, issued on Sep. 26, 1950 to Warren E. Little, discloses an adjustable ladder anchor. Little's ladder anchor comprises a two element shaft in which the elements telescopically engage one another. The first element has means for accepting a stake-like member to secure the ladder anchor to the ground. The second element has an "S"-shape element for engaging a round bottom rung of a ladder. Although Little's anchor prevents the ladder from moving away from the building, it does not provide side-to-side stability for the ladder, and in no way can it be used on a ladder having non-circular rungs.

U.S. Pat. No. 4,007,807, issued on Feb. 15, 1977 to Kenneth W. Pogwizd, discloses a ladder stabilizer for use on both penetrable and impenetrable surfaces. Pogwizd's stabilizer is constructed from a chain that, by employing fasteners such as eye-hooks, engages the outer sides of the rail members of a ladder. Depending upon the surface, the chain is then attached to a spike that is driven into the ground or to a weighted box that is placed on the surface of the ground between the base of the structure against which the upper portion of the ladder is leaning and the lower portion of the ladder where it engages the ground.

Furthermore, U.S. Pat. No. 4,576,250, issued on Mar. 18, 1986 to Robert Marish, discloses ladder stops to be placed in the ground adjacent the feet of a ladder to prevent the ladder from displacing horizontally away from a structure against which it is placed. Marish's ladder stops comprise two main elements; the first element is a pointed, ground engaging member whereby the second element, a U-shaped member, is welded thereto. The weld positions the U-shaped member in a range from 10° to 45° off normal with respect to the ground engaging member. When used, the two ground engaging members are placed into the ground, one adjacent each ladder foot, such that U-shaped members surround the feet of the ladder. Again, as was seen in the Pogwizd ladder stabilizer, although both Pogwizd and Marish prevent a ladder from displacing away from a structure, neither of the above mentioned patented inventions provide side-to-side stability for the ladder.

U.S. Pat. No. 4,669,576, issued on Jun. 2, 1987 to Leroy W. Jones et al., discloses a safety ladder foot for stabilizing the side rail of a ladder. One embodiment of Jones' ladder foot is seen as a ground engaging spike member having a cage attached thereto for holding the lower, normally ground engaging, base portion of the ladder's side rail. Jones' ladder foot when used with a second foot on the second side rail of the ladder provides both displacement resistance and some side-to-side stability, but use thereof is limited to ladders with side rails of rectangular cross-sections having no secondary feet to engage the ground.

Lastly, U.S. Pat. No. 5,054,579, issued on Oct. 8, 1991 to John A. Moson, discloses a ladder having an anchoring system. One embodiment of Moson's anchoring system comprises one or two pegs having either a "J" or "L" shape. The long leg of the peg is to be driven into the ground, while the shorter leg is for frictionally engaging the upper surface of the lowest rung of the ladder. However, due to the fact that the pegs do not completely engage the rung of the ladder, the possibility still exists of the ladder sliding away from the structure partially supporting same.

None of the above inventions and patents, taken either singly or in combination, is seen to describe the instant invention as claimed. A "U" shaped member for engaging both the ladder and the ground is not seen in the prior art. A reinforced impact area for driving the ladder anchoring pins into the ground as well as pivotal handle means for aiding in the removal of the present invention from the ground and simplifying the transportation of the ladder anchoring pins is also not seen in a single patented ladder anchor.

SUMMARY OF THE INVENTION

The present invention, when used as a pair, has the ability to provide exceptional support and stability for a ladder that engages the ground and the side of a structure.

Accordingly, it is a principal object of the invention to provide support and stability to any ladder by utilizing a single device to engage both the bottom rung of a ladder and the ground upon which the ladder is positioned to prevent the inadvertent displacement of the ladder across the ground away from a structure that is also providing support for the ladder.

It is another object of the invention to provide side-to-side stability for a ladder supported by the ground and a structure by utilizing a pair of ladder anchor pins, placed over the bottom rung of a ladder at opposite ends of the rung, so that the ladder is anchored to the ground in such a manner that it has great resistance to side-to-side movement.

It is a further object of the invention to provide such a stabilizing device that is both simple and quick to install and easy to remove from engagement with the ground and ladder by providing a broad, adequately strong, impact area to receive blows when driving the ladder anchor pins in to the ground, and a pivotal handle for removing the ladder anchor pins and transporting the same in an easy and convenient manner.

Still another object of the invention is to decrease the possible displacement of a ladder away from a structure against which it is leaning by utilizing a U-shaped anchoring device that will fully encompass the lowest rung of a ladder as well as the ground upon which the ladder is residing such that the ladder is incapable of frictionally, or otherwise, disengaging from the anchor, and is furthermore capable of being used on any type of ladder without having to specially adapt the ladder to accept the anchoring pins.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a sectional view taken along lines 3—3 of FIG. 4 illustrating the engagement of the anchoring pin with the lowest rung of the ladder.

FIG. 4 is a front view of the invention with two anchoring pins used giving added side-to-side support to the ladder being restrained.

Similar reference characters denote corresponding features consistently throughout the attached drawings.

DETAILED DESCRIPTION OF THE PREFERRED EMBODIMENT

Figure 1:
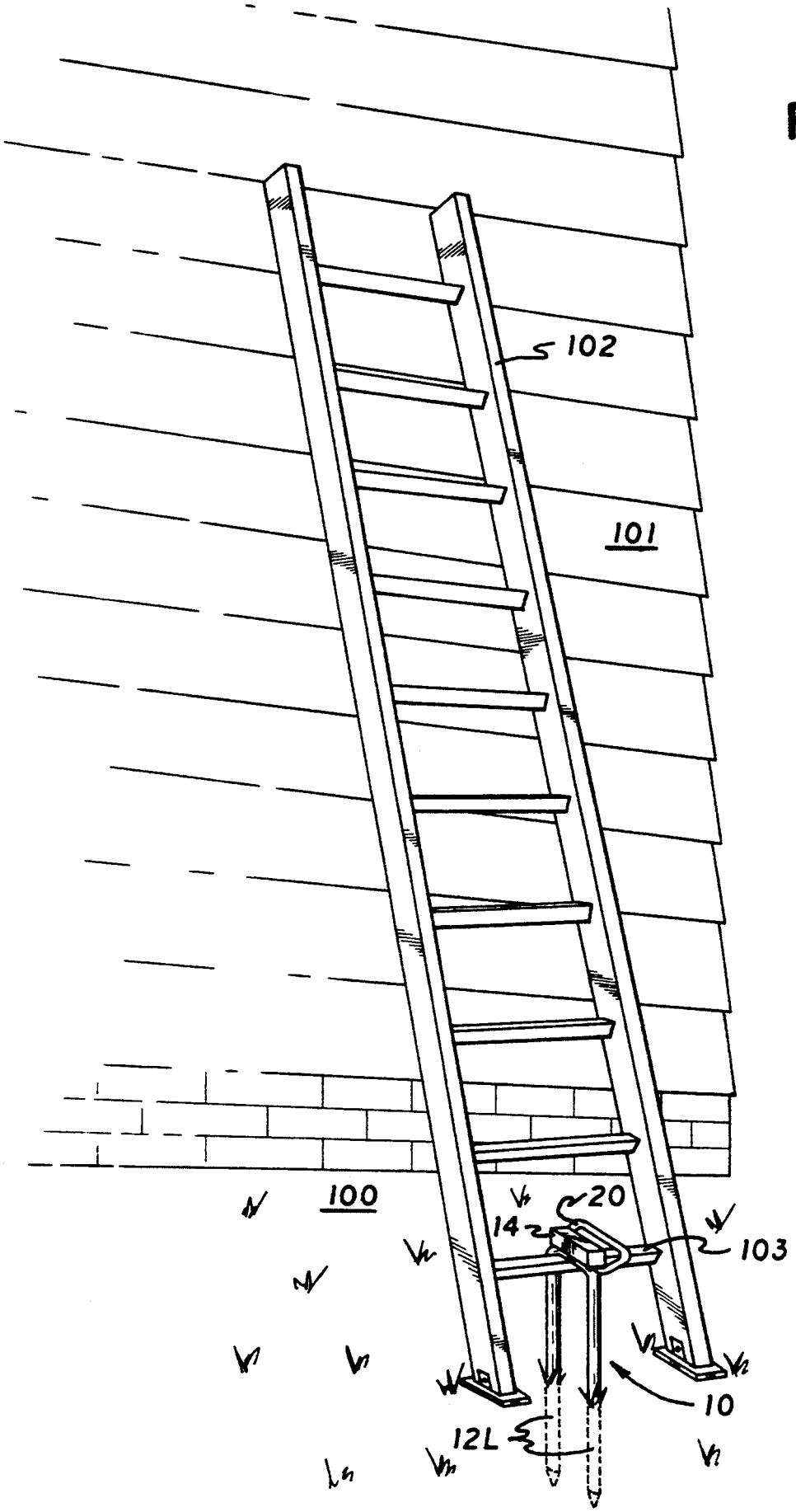
FIG. 1 is an environmental perspective view of a single anchoring pin as placed over the bottom rung of a ladder.

The present invention has been developed in order to allow individuals utilizing straight ladders 102 and extension ladders 104 (FIG. 4) that are placed upon the ground 100 and against a structure 101, such as a house, garage, trailer, etc., to operate ladder 102 in a safe manner. It is not always convenient or possible to have a second individual present to hold and stabilize ladder 102 that is being used by a first individual. Accordingly the present invention allows the first individual to safely use and operate ladder 102, by placing a single ladder anchoring pin 10 across the lowest rung 103 of ladder 102 (FIG. 1).

Figure 2:
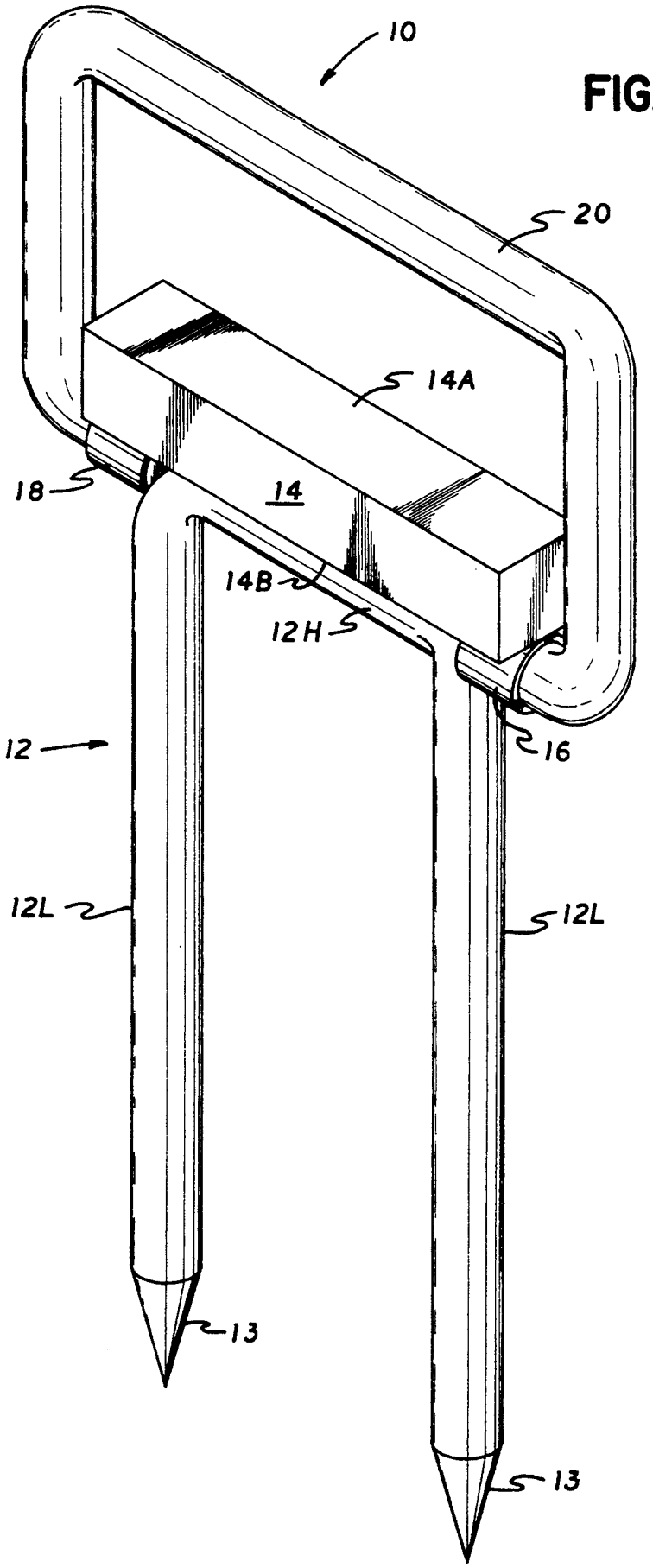
FIG. 2 is perspective view of an anchoring pin.

Referring now to FIG. 1 and FIG. 2, a ladder anchoring pin 10 is seen in use anchoring a ladder 102 to the ground 100. Ladder anchoring pin 10 engages the lowest rung 103 of ladder 102 and secures it to the ground 100. Ladder anchoring pin 10 comprises a U-shaped member 12 having a rung engaging section 12H incorporated normal to two ground engaging sections 12L and 12L having a length substantially longer than the length of section 12H of U-shaped member 12. Rung engaging section 12H is seen as a substantially smooth rod shaped such that the two ground engaging rod sections 12L and 12L extend normal from a first and second end of section 12H. In addition, both ground engaging rod sections 12L and 12L are each seen as having a first end and a second end. The first ends of 12L and 12L extend normal from rung engaging section 12H. The second ends of 12L and 12L are seen as conical spikes 13 and 13 for engaging ground 100.

Connected to rung engaging section 12H of U-shaped member 12 is impact member 14. Impact member 14 is connected along lower surface 14B (FIG. 2) to section 12H by any suitable means for the material being used; in this the preferred embodiment ladder anchoring pin 10 is constructed from a metallic substance. Hence, impact member 14 is welded to section 12H of U-shaped member 12, as shown at W in FIG. 3. Atop impact member 14 is a flat planar surface 14A for accepting and distributing driving blows required to set ladder anchoring pin 10 into ground 100. Attached to both impact member 14 and U-shaped member 12 are handle support collars 16 and 18. Again, many suitable means for attaching support collars 16 and 18 to impact member 14 and U-shaped member 12 may be utilized, but for the embodiment presented herein, welding the above mentioned components of ladder anchoring pin 10 together is considered most effective. Inserted into support collars 16 and 18 are the ends of substantially rectangular shaped handle 20. Handle 20 may be constructed of the same material as U-shaped member 12, a substantially smooth metallic rod, but of a smaller gauge.

When securing a ladder 102 to the ground 100, at least one ladder anchoring pin 10 is required so that the base of ladder 102 will not displace from the base of structure 101 against which it is leaning. For short ladders, such as ladder 102 (FIG. 1), the ladder is usually properly secured with a single ladder anchoring pin 10 driven into the ground 100 and engaging the approximate center of the lower rung 103 of ladder 102. However, many times in the construction industry, a longer extension type ladder 104 (the base of which is illustrated in FIG. 4) may be required by the job at hand. In order to better secure extension ladder 104 to the ground 100 a pair of ladder anchoring pins 10, 10 should be utilized (see FIG. 4). When two ladder anchoring pins 10, 10 are utilized, they should be placed as far apart as possible when engaging the lowest rung **103*e* of extension ladder 104. By placing the anchoring pins 10, 10 in this manner, larger moment arms are created in regard to the side rails of ladder 104, creating a greater resistance to side-to-side tipping thereof while in use, despite the additional height and natural instability of extension ladder 104**.

Due to the specific construction of the inventive ladder anchoring pins 10, it is not necessary to modify any ladder, standard type 102 or extension type 104, in any instance. Furthermore, ladder anchoring pins 10 are capable of engaging and securing any ladder rung regardless of cross-sectional shape (see FIG. 3). These features, along with the handle 20 for removing a ladder anchoring pin 10 from engagement with the ground 100, provide a superior ladder anchoring pin to those found on the market.

It is to be understood that the present invention is not limited to the sole embodiment described above, but encompasses any and all embodiments within the scope of the following claims.

I claim:

1. A ladder anchoring pin for securing a ladder having a bottommost horizontal rung to the ground by said bottommost horizontal rung, as the ladder engages both the ground and a supporting surface, said ladder anchoring pin comprising:

a single, U-shaped member for simultaneously engaging the ground and the bottommost horizontal rung of said ladder, said U-shaped member comprising three distinct sections, a first rung engaging section, a second ground engaging section, and a third ground engaging section; said U-shaped member being defined by the three sections wherein said first section is normal to said second and said third sections;

an impact member having at least an upper surface and lower surface, said lower surface being permanently attached to said first section of said U-shaped member by a weld, and said upper surface being a flat, planar surface for receiving impacts that force said ladder anchoring pin over the bottommost horizontal rung of the ladder and into the ground there below; and, a handle, pivotally attached to said ladder anchoring pin, and extending across the length of said first section, for removing said ladder anchoring pin from engagement with the ground and the ladder.

2. The ladder anchoring pin according to claim 1, wherein said U-shaped member, said impact member, and said handle are made of metal.

3. A ladder anchoring pin for securing a ladder having a bottommost horizontal rung to the ground by said bottommost horizontal rung, as the ladder engages both the ground and supporting surface, said ladder anchoring pin comprising;

a single, U-shaped member for simultaneously engaging the ground and the bottommost horizontal rung of said ladder, said U-shaped member comprising three distinct sections, a first rung engaging section, a second ground engaging section, and a third ground engaging section; said U-shaped member being defined by the three sections wherein said first section is normal to said second and said third sections;

an impact member having at least an upper surface and lower surface, said lower surface being permanently attached to said first section of said U-shaped member by a weld, and said upper surface being a flat, planar surface for receiving impacts that force said ladder anchoring pin over the bottommost horizontal rung of the ladder and into the ground therebelow;

a handle, pivotally attached to said ladder anchoring pin, for removing said ladder anchoring pin from engagement with the ground and the ladder; and metallic handle support collars attached to said U-shaped member and said impact member for pivotally engaging said handle.

4. The ladder anchoring pin according to claim 3, wherein said U-shaped member, said second and said third sections, said impact member, and said support collars for receiving said handle therein, are attached to one another by welds.

5. A method of anchoring a ladder to the ground and at a later time releasing the ladder from the ground comprising the steps of:

positioning the ladder upon the ground and against a structure such that the ladder is in a usable configuration;

positioning at least one ladder anchoring pin comprising a U-shaped member having a first rung engaging section, a second ground engaging section, and a third ground engaging section, and having a handle and an impact area about a lowest rung of the ladder and placing the handle of the ladder anchoring pin below the impact area thereof, said handle extending across the length of said first section; and striking the ladder anchoring pin upon the impact area, driving the ladder anchoring pin down into the ground to a point at which a rung engaging section of the ladder anchoring pin is flush against the lowest rung of the ladder forcing the ladder against the ground below; and, to later remove the ladder anchoring pin, pivoting the handle of the ladder anchoring pin until the handle is in a substantially vertical position; and applying a vertically directed upward force to the handle, such that the ladder anchoring pin will begin to displace away from the lowest rung the ladder, as well as pull free from the ground.

* * * * *